US008186426B2

(12) United States Patent
Nelson

(10) Patent No.: US 8,186,426 B2
(45) Date of Patent: May 29, 2012

(54) WELLHEAD SEAL ASSEMBLY

(75) Inventor: John E. Nelson, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 168 days.

(21) Appl. No.: 12/332,975

(22) Filed: Dec. 11, 2008

(65) Prior Publication Data

US 2010/0147533 A1 Jun. 17, 2010

(51) Int. Cl.
*E21B 19/00* (2006.01)

(52) U.S. Cl. ..... 166/88.3; 277/323; 277/328

(58) Field of Classification Search ..... 166/208, 166/217, 379, 387, 88.3, 77.13, 196; 277/312, 277/322, 328

See application file for complete search history.

(56) References Cited

U.S. PATENT DOCUMENTS 4,372,563 A * 2/1983 Diehl et al. ..... 277/328
4,665,979 A * 5/1987 Boehm, Jr. ..... 166/208
4,714,111 A 12/1987 Brammer
4,742,874 A * 5/1988 Gullion ..... 166/348
4,823,871 A * 4/1989 McEver et al. ..... 166/182
4,932,472 A 6/1990 Boehm, Jr.
5,060,724 A * 10/1991 Brammer et al. ..... 166/208
5,174,376 A * 12/1992 Singeetham ..... 166/208
5,285,853 A 2/1994 Eckert et al.
5,456,314 A 10/1995 Boehm, Jr. et al.
6,367,558 B1 * 4/2002 Borak, Jr. ..... 166/387
2010/0126736 A1 * 5/2010 Ellis et al. ..... 166/387

OTHER PUBLICATIONS

U.S. Appl. No. 12/268,858, filed Nov. 11, 2008.

* cited by examiner

*Primary Examiner* — David Bagnell
*Assistant Examiner* — Kipp Wallace
(74) *Attorney, Agent, or Firm* — Bracewell & Giuliani LLP

(57) ABSTRACT

A seal assembly for sealing between wellhead members in a wellhead, the assembly may include a seal element and a lockdown member. The seal assembly is attachable to either one of the wellhead members by coupling the lockdown member to a locking surface on the wellhead member. The lockdown member and locking surface may include corresponding profiles for mating engagement thereby preventing relative movement between the wellhead member and seal assembly.

9 Claims, 7 Drawing Sheets

WELLHEAD SEAL ASSEMBLY

FIELD OF THE INVENTION

This invention relates in general to wellhead assemblies and in particular to a seal for sealing between inner and outer wellhead members.

BACKGROUND OF THE INVENTION

Seals are used between inner and outer wellhead tubular members to contain internal well pressure. The inner wellhead member may be a tubing hanger that supports a string of tubing extending into the well for the flow of production fluid. The tubing hanger lands in an outer wellhead member, which may be a wellhead housing, a Christmas tree, or a tubing head. A packoff or seal seals between the tubing hanger and the outer wellhead member. Alternately, the inner wellhead member might be a casing hanger located in a wellhead housing and secured to a string of casing extending into the well. A seal or packoff seals between the casing hanger and the wellhead housing.

A variety of seals of this nature have been employed in the prior art. Prior art seals include elastomeric and partially metal and elastomeric rings. Prior art seal rings made entirely of metal for forming metal-to-metal seals are also employed. The seals may be set by a running tool, or they may be set in response to the weight of the string of casing or tubing. One type of prior art metal-to-metal seal has inner and outer walls separated by a conical slot. An energizing ring is pushed into the slot to deform the inner and outer walls apart into sealing engagement with the inner and outer wellhead members. The energizing ring is a solid wedge-shaped member. The deformation of the inner and outer walls exceeds the yield strength of the material of the seal ring, making the deformation permanent.

Thermal growth between the casing or tubing and the wellhead may occur, particularly with wellheads located at the surface, rather than subsea. The well fluid flowing upward through the tubing heats the string of tubing, and to a lesser degree the surrounding casing. The temperature increase may cause the tubing hanger and/or casing hanger to move axially a slight amount relative to the outer wellhead member or each other. During the heat up transient, the tubing hanger and/or casing hanger can also move radially due to temperature differences between components and the different rates of thermal expansion from which the component materials are constructed. If the seal has been set as a result of a wedging action where an axial displacement of energizing rings induces a radial movement of the seal against its mating surfaces, then sealing forces may be reduced if there is movement in the axial direction due to pressure or thermal effects. A reduction in axial force on the energizing ring results in a reduction in the radial inward and outward forces on the inner and outer walls of the seal ring, which may cause the seal to leak. A loss of radial loading between the seal and its mating surfaces due to thermal transients may also cause the seal to leak.

A need exists for a technique that addresses the seal leakage problems described above. In particular, a need exists for a technique to maintain a seal between inner and outer wellhead members experiencing changes in relative positions due to thermal affects, especially those caused by high pressure and high temperature wellbore fluids. The following techniques may solve one or more of these problems.

SUMMARY OF THE INVENTION

Disclosed herein is a seal assembly for sealing within an annulus between two coaxially disposed wellhead members where one of the wellhead members may be subjected to axial expansion, such as from applied heat. The seal assembly includes a seal element axially supported within the annulus and a lockdown ring mounted to the seal assembly that can be engaged with the axially expandable wellhead member. The ring can have a contoured surface on a side opposite the axially expandable wellhead member. Axially engaging the lockdown ring contoured surface with an energizing ring the lockdown ring is radially moved against the axially expandable wellhead member and couples the seal assembly to the axially expandable wellhead member. In one embodiment the seal assembly is formed from a first leg, a second leg, and an annular channel between the legs. The first leg seals against the outer wellhead member and supports the lockdown ring while the second leg seals against the inner wellhead member. The annular channel receives the energizing member. The lockdown ring may include a grooved locking surface on its side facing the axially expandable wellhead member. The grooved surface may align with a profiled surface on the axially expandable wellhead member. In one embodiment the lockdown ring may comprise a base and a cantilevered member connected to the base on one end. The contoured locking surface is on the end of the cantilevered member.

Also disclosed herein is a wellhead assembly having an outer wellhead member for anchoring in a borehole and an inner wellhead member landed within the outer wellhead member. An annulus forms between the inner and outer wellhead members. The inner wellhead member may include a grooved surface on its exterior surface. A seal assembly is included in the annulus. In one embodiment, the seal assembly is made up of a first portion in sealing contact with the outer wellhead member and a second portion in sealing contact with the inner wellhead member outer surface. An annular channel is optionally located between the first and second portions. Inserting an energizing ring into the channel between the first and second portions of the seal assembly can force the first and second portions apart from each other. A cam surface can be disposed on the energizing ring inner diameter. This embodiment may also include a lockdown ring that when pushed radially inward can compress. The ring may be supported on the seal assembly inner portion and may be engaged by the cam surface. Inserting the energizing ring into the channel pushes the lockdown ring into engagement with the grooved profile on the inner wellhead member.

The present disclosure further includes a method of sealing between an annulus between outer and inner wellhead members. The method may include providing a seal assembly with a lock ring and positioning the seal assembly in the annulus. The seal assembly can be deformed into sealing engagement with the inner and outer wellhead members with an energizing ring. Also, the lock ring can be deformed with the energizing ring to cause it to lock the seal assembly to one of the wellhead members.

DETAILED DESCRIPTION OF THE INVENTION

Figure 1:
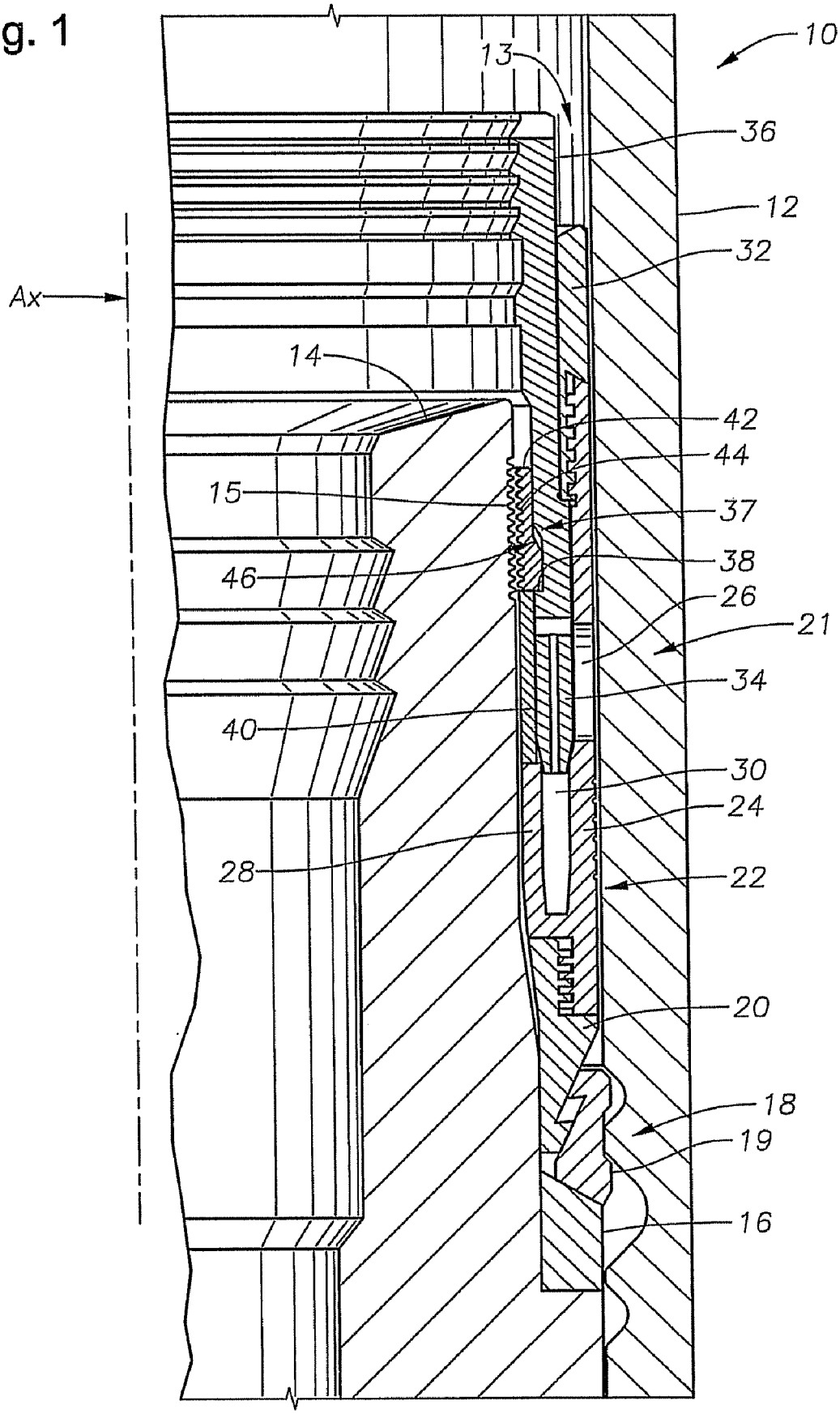
FIG. 1 is a sectional view of a seal assembly embodiment as disclosed herein.

With reference now to FIG. 1 an example of a wellhead assembly 10 is provided in a side sectional view. In the example of FIG. 1, the wellhead assembly 10 comprises inner and outer wellhead members coaxially disposed and spaced apart thereby forming an annulus there between. The seal assembly is selectively affixed to either of the inner or outer wellhead members to prevent relative movement between the wellhead member and the seal assembly when or if either of the wellhead assemblies axially moves with respect to the other.

In the specific embodiment of FIG. 1, the wellhead assembly 10 comprises a wellhead housing 12 affixed at an upper end of a wellbore (not shown) and coaxially circumscribing a casing hanger 14. The spaced apart distance between the respective inner and outer circumferences of the casing hanger 14 and wellhead housing 12 form an annulus 13. The casing hanger 14 outer diameter transitions to extend outward into contact with the wellhead housing 12 inner diameter; thereby defining the lower terminal end of the annulus 13. A shoulder lockdown 16 is shown provided in the annulus 13 lower terminal end. The lockdown shoulder 16 upper surface slopes downward with travel away from the casing hanger 14 outer circumference.

A hanger lockdown assembly 18 is shown situated in the annulus 13 resting atop the lockdown shoulder 16. The hanger lockdown 18 as shown comprises an outer coupling 19 and an inner coupling 20 in mating contact. The outer coupling 19 lower surface is similarly sloped to the lockdown shoulder 16 upper surface. Thus a force parallel to the wellhead assembly 10 axis $A_X$ produces resultant forces to outwardly radially urge the outer coupling 19 against the wellhead housing 12 inner circumference. The outer coupling 19 contacts the inner coupling 20 along a slanted surface downwardly oriented and directed towards the axis $A_X$. Thus the contact surface between the outer and inner coupling 19, 20 radially outwardly urges the outer coupling 19 against the wellhead housing 12 while inwardly urging the inner coupling 20 against the outer radius of the casing hanger 14. The "slip-like" configuration of the hanger lockdown 18 increases coupling forces between the casing hanger 14 and wellhead housing 12 in response to forces along the wellhead assembly 10 axis $A_X$ that may attempt to dislodge these two members.

A seal assembly 21 is shown in the annulus 13 threadingly affixed to the inner coupling 20 upper end and extending upward therefrom. In the embodiment illustrated in FIG. 1, the seal assembly 21 comprises a seal element 22 an optional seal stop sleeve 40, and a lockdown member 42. In this embodiment, the lockdown member 42 is a lockdown ring. The seal element 22 shown may be comprised of metal, soft metal, or an elastomeric material. The seal element 22 comprises an outer member 24 shown threaded to the inner coupling 20 on its lower end; the outer member 24 extends upward along the wellhead housing 12 inner circumference. The outer member 24 upper end terminates in a threaded fitting with an annular nut 32. Thus the outer member 24 is a generally annular member and having a cross-sectional thickness less than the annulus 13 thickness. The outer member 24 includes an optional slot 26 shown provided along a portion of its length.

The seal element 22 further comprises an annular inner member 28 shown laterally projecting from the outer member 24 above the inner coupling 20. The inner member 28 extends from the outer member 24 substantially perpendicular to the axis $A_X$ through the annulus 13. At the casing hanger 14 outer circumference the inner member 28 angles upward to run generally parallel to the axis $A_X$. A shoulder 38 is shown formed on an inner side of the energizer ring 36 lower end that faces the casing hanger 14.

Shown provided on top of the inner member 28 upper end is the annular seal stop sleeve 40, the sleeve 40 is disposed in the annulus 13 adjacent the casing hanger 14 outer diameter coaxial about the axis $A_X$. The sleeve 40 may be comprised of a resilient load-bearing material, examples of which include steel, metal alloys, and composites.

The lockdown ring 42 is shown in contact with the seal stop sleeve 40 upper end also in the annulus 13 and coaxial about the axis $A_X$. As shown in FIG. 1, the lockdown ring 42 is spaced apart from the casing hanger 14 in a non-coupled configuration. In the non-coupled position, the lockdown ring 42 lower end rests on the shoulder 38. A grooved profiled surface 44 is shown on the lockdown ring 42 on a side facing the casing hanger 14. Lockdown ring 42 is thicker at its base proximate to the seal stop sleeve 40. The lockdown ring 42 thickness decreases above a transition 46 on the ring 42 rearward surface facing the wellhead housing 12. The lockdown ring 42 front surface, although profiled, is generally planar and does not include a transition.

An annular energizer ring 36 is also provided in the annulus 13 on the nut 32 inner circumference. An energizer 34 protrudes into the space 30 from the energizer ring 36 lower end. As will be discussed in further detail below, the energizer 34 is configured for insertion into the space 30 to form a sealing surface for sealing between the casing hanger 14 and wellhead housing 12. The nut 32 may optionally include a collar-like extension on its inner circumference shrouding an upper portion of the seal element 22 outer member 24. The extension prevents snagging the energizer ring 36 on the outer member 24 upper end during assembly. The energizer ring 36 includes a transition 37 above the shoulder 38 on its inner circumference that reduces the energizer ring 36 inner radius.

Figure 2:
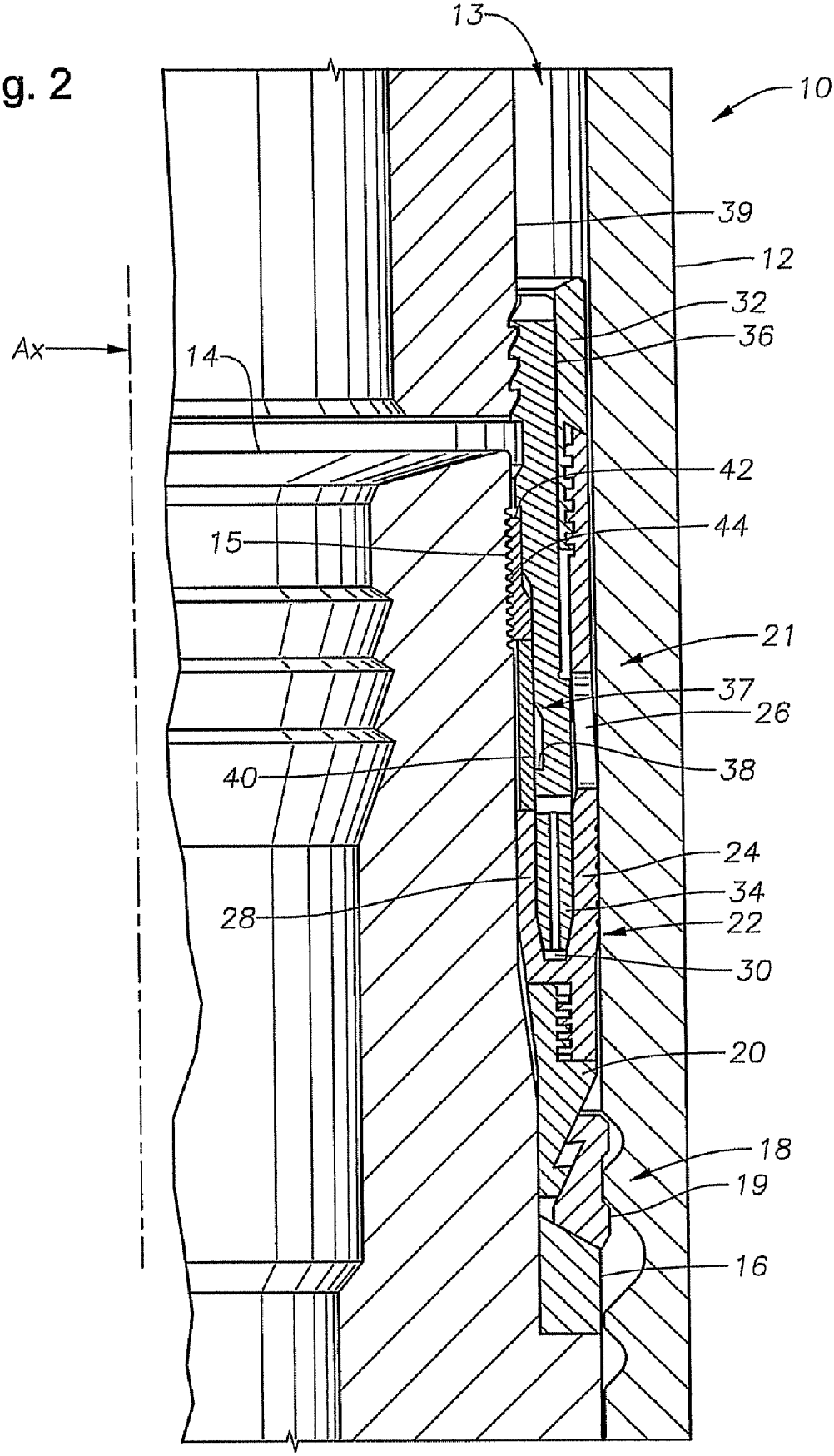
FIG. 2 is a sectional view of the seal assembly of FIG. 1 and shown in the landed position.

With reference now to FIG. 2, a side cross-sectional view of the wellhead assembly 10 of FIG. 1 illustrates the seal assembly 21 coupled to the casing hanger 14. As shown in FIG. 2, the energizer ring 36 has been urged downward, which may occur by the use of a running tool 39. Urging the energizer ring 36 downward pushes the energizer 34 into the space 30. Preferably, the energizer 34 thickness exceeds the space 30 thickness thereby pushing the inner member 28 and outer member 24 in opposite directions into sealing contact with both the casing hanger 14 and wellhead housing 12. The energizer 34 may fill all or a portion of the space 30. Downwardly urging the energizer ring 36 also drives the shoulder 38 and transition 37 lower and adjacent the seal stop sleeve 40.

With respect to the axis $A_X$, the lockdown ring 42 outer diameter above its transition 37 is greater than the energizer ring 36 inner diameter below transition 46. Thus downwardly moving the energizer ring 36 to push the transition 37 below the transition 46 urges the lockdown ring 42 against the casing hanger 14. This engages the lockdown ring 42 profiled surface 44 with the casing hanger 14 profile surface 15. Thus, retaining the energizer ring 36 in the configuration illustrated in FIG. 2, sustains engagement between the lockdown ring 42 and the casing hanger 14. This engagement with the corresponding contoured surfaces 15, 44 on the casing hanger 14 and lockdown ring 42 fix the seal assembly 21 to the casing hanger 14 thereby preventing relative movement between the seal assembly 21 and casing hanger 14. Thus avoiding potential damage caused by the casing hanger 14 expanding and sliding past the seal assembly 21. It should be pointed out, that the corresponding profiled surfaces 15, 44 may include many different configurations. For example, the surfaces 15, 44 may include a series of interlocking teeth, corresponding undulations, as well as an indentation with corresponding recess on the opposing surface.

In one example of use of the present device, the running tool 39 is engaged with the energizer ring 36 upper end, as shown in FIG. 2. Downwardly urging the running tool 39 in turn pushes the energizer ring 36 into the annulus 13 and slides the shoulder 38 and transition 37 formed on the energizer ring 36 inner circumference past the lockdown ring and adjacent the seal stop sleeve 40. Passing the transition 37 from the energizer ring 36 across the lockdown ring 42 transition 46 engages the thicker base section of the ring 42 with the energizer ring 36 thicker inner radius. This in turn pushes the lockdown ring 42 into engagement with the locking surface 15 provided on the casing hanger 14. Conversely, removing the seal element 21 can be initiated by upwardly pulling the energizer ring 36 out of the annulus 13 such as by use of a running tool 39. Removing the energizer ring 36 from behind the lockdown ring 42 allows the lockdown ring 42 to disengage from the casing hanger 14 thereby allowing removal of the seal assembly 21.

Figure 3:
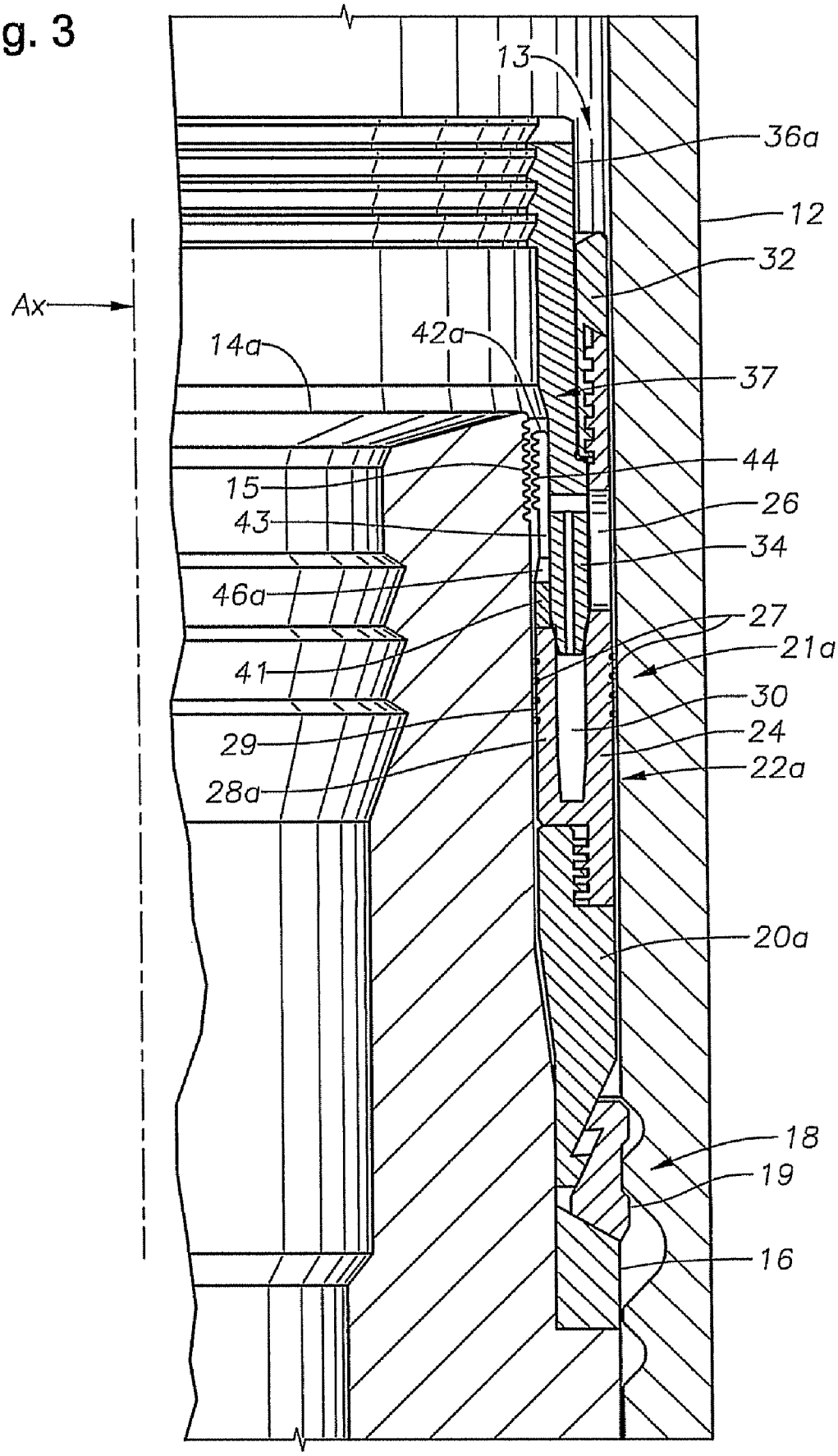
FIG. 3 is a sectional view of an optional seal assembly embodiment as disclosed herein.
Figure 4:
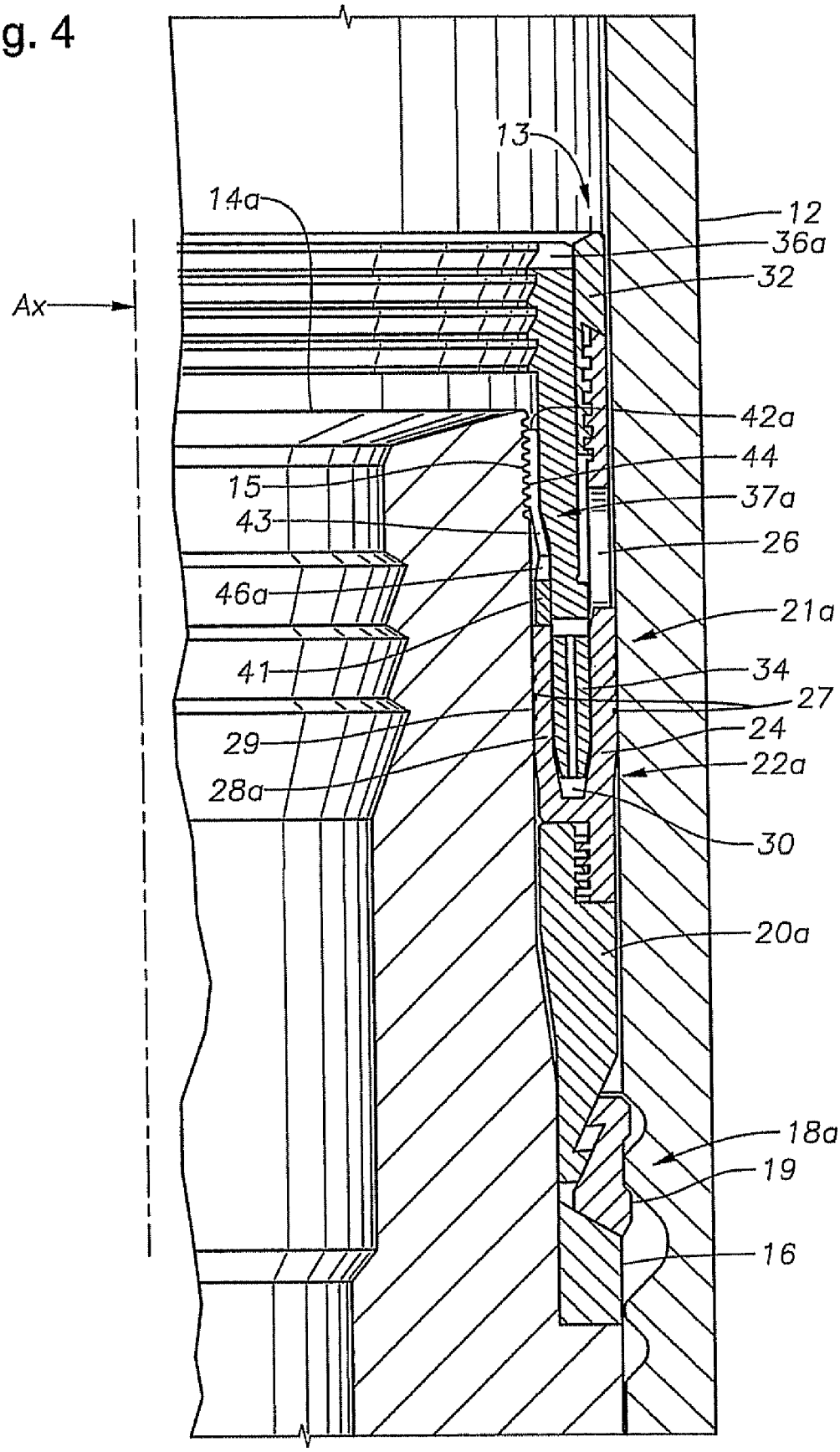
FIG. 4 is a sectional view of the seal assembly of FIG. 3 and shown in the landed position.

FIGS. 3 and 4 provide an alternative embodiment of a seal assembly 21*a* for locking engagement between the seal assembly 21*a* and a casing hanger 14*a*. In the embodiment of FIGS. 3 and 4, the lockdown ring 42*a* includes a base 41 having a cantilevered member 43 depending upward from the base 41. A transition 46*a* defines the base 41 and member 43 border. The cantilevered member 43 includes a profiled surface 44 on its upper end that faces the casing hanger 14*a*. The energizer ring 36*a* inner side is inwardly contoured above a transition 37*a*, making it closer to the axis $A_X$ than the lockdown ring 42*a* rearward side. The seal assembly 21*a* of FIG. 3 includes overlays 27 (also referred to as inlays) on the member inner surface 29 and the seal assembly 21*a* surface opposing the wellhead housing 12. The overlays 27 may be formed by installing a soft metal into grooves formed in the seal assembly 21*a* surfaces.

Figure 5:
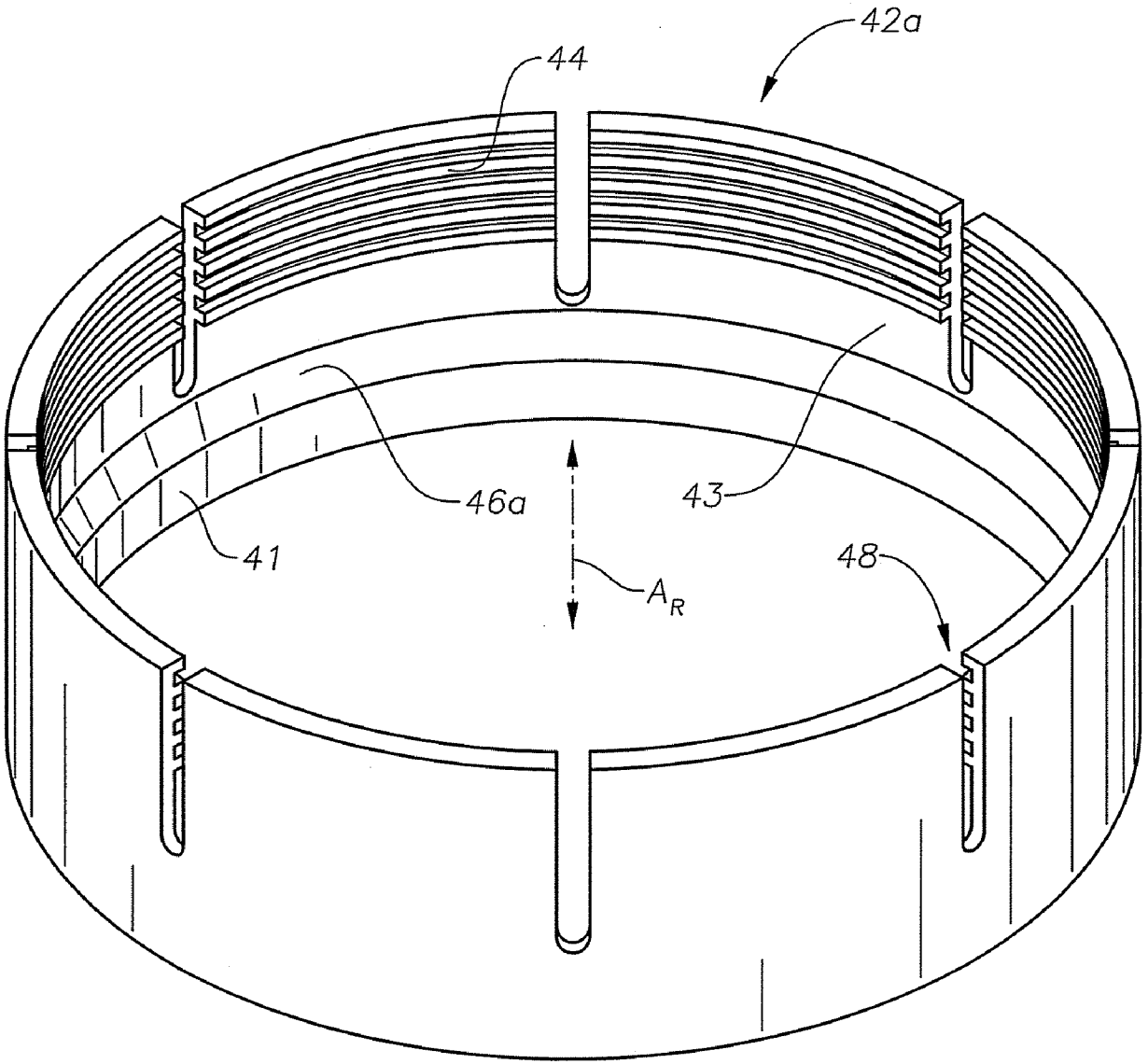
FIG. 5 is a perspective view of an embodiment of a lockdown ring.

A perspective view of the lockdown ring 42*a* of FIG. 4 is provided in FIG. 5. As shown, the lockdown ring 42*a* is a substantially annular member with its profiled surface 44 extending inside of its upper end. The transition 46*a* identifies where the cantilevered member 43 depends from the base 41. In this embodiment, the locking down ring 42*a* includes slots 48 formed through the ring 42*a* along a portion of the length of the ring 42*a*. The slots 48 are substantially oriented with the lockdown ring 42*a* axis $A_R$. During coupling between the seal assembly 21*a* and casing hanger 14*a*, the slots 48 allow the lockdown ring 42*a* to reduce its diameter while in the coupling configuration.

FIG. 4 depicts coupling between the seal assembly 21*a* and casing hanger 14*a*. In this embodiment, the energizer ring 36*a* has been downwardly moved relocating the transition 37*a* below the cantilevered member 43 upper end. This aligns the ring 36*a* contoured inner side adjacent the lockdown ring 42*a* outer side thereby inwardly bending the cantilevered member 43 and the profiled surface 44 against the hanger 14*a* profiled surface 15. The corresponding profiled surfaces 15, 44 couple the seal assembly 21*a* to the casing hanger 14*a* and prevent seal element 22*a* movement with respect to the casing hanger 14*a*. Also included with this embodiment are raised elements 27 extending from the casing hanger 14*a* outer surface into contact with the member inner surface 29.

Figure 6:
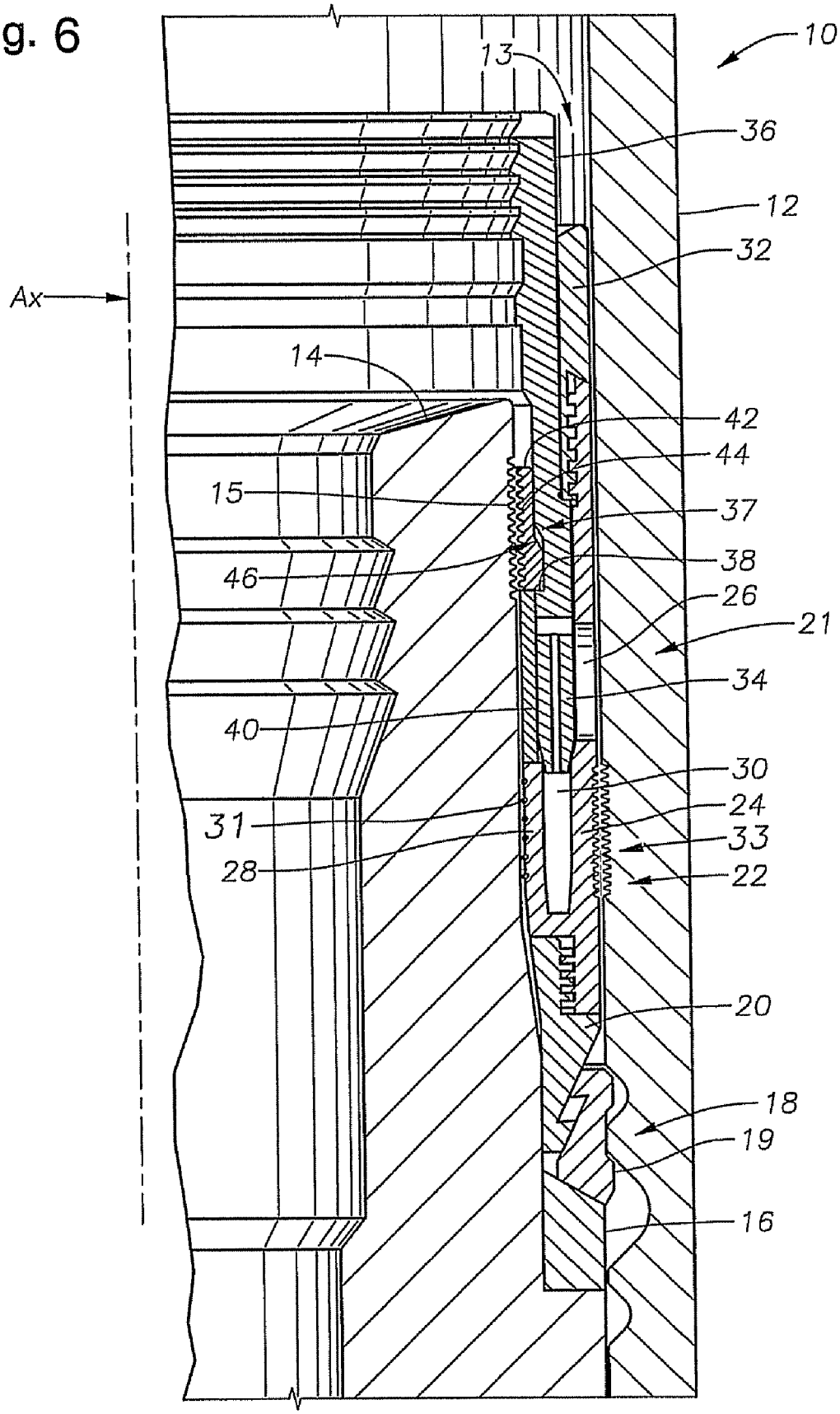
FIGS. 6 and 7 depict a wellhead assembly with a seal assembly having overlays.
Figure 7:
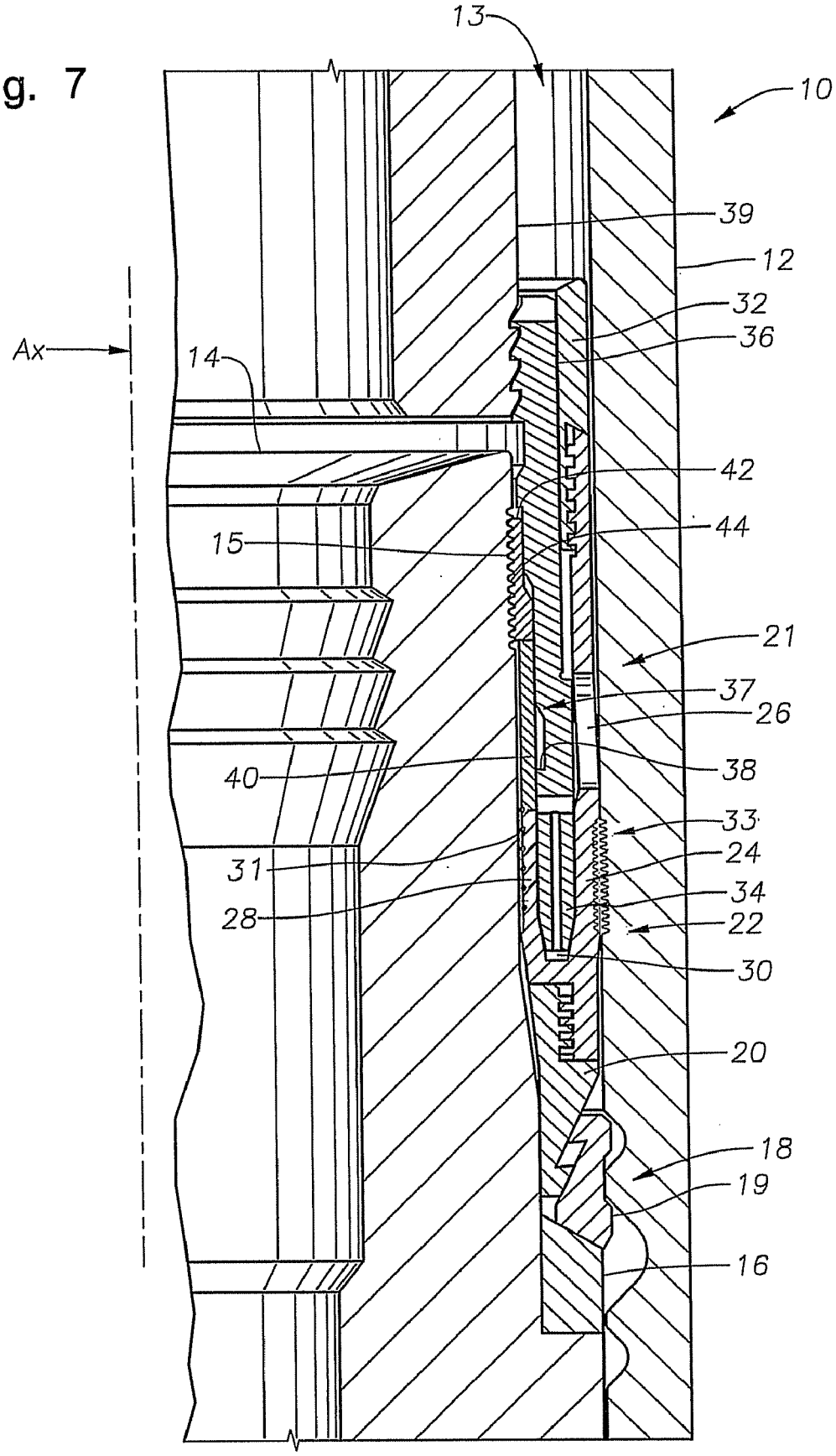

FIGS. 6 and 7 depict an alternative wellhead assembly 10 embodiment with a seal assembly 21 having overlays 31 on its surface mating with the casing hanger 14. The seal assembly 21 surface facing the wellhead housing 12 is shown profiled to include what are referred to as wickers 33. The portion of the wellhead housing 12 facing the seal assembly wickers 33 includes matching wickers 33. Engaging the wickers 33 forms a seal between the seal assembly 21 and the wellhead housing 12.

While the invention has been shown in only one of its forms, it should be apparent to those skilled in the art that it is not so limited but is susceptible to various changes without departing from the scope of the invention. For example, the seal could be configured for withstanding pressure in only a single direction, if desired, having only a single energizing ring. Each energizing ring could flexible, rather than solid.

The invention claimed is:

1. A seal assembly for sealing within an annulus between inner and outer coaxially disposed wellhead members, the inner wellhead member being axially expandable, the seal assembly comprising:

a metal seal element disposable within the annulus and having an inner leg and an outer leg;

an energizing ring selectively insertable into a slot between the inner and outer legs in the seal element and having, a cam surface an inner circumference; and an annular lockdown member having a wickered profile on an inner radial surface of the lockdown member and that is selectively moveable from unengaged configuration unengaged with the inner wellhead member into an engaged configuration with the profile engaged with a corresponding wickered profile on the inner wellhead member, so that when the energizing ring is inserted into the slot and the cam surface of the energizing ring contacts an outer radial surface of the lockdown member, the lockdown member is moved into the engaged configuration with the inner wellhead member and is moveable with respect to the outer wellhead member as the inner wellhead member thermally expands; and an upward facing shoulder on an inner circumference of the energizing ring below the lockdown member, so that when the energizing ring is moved upward from the slot and the cam surface of the energizing ring is moved away from the lockdown member, the upward facing shoulder engages a lower end of the lockdown member to move the lockdown member from the annulus.

2. The seal assembly of claim 1, further comprising:

an annular recess on the inner circumference of the energizing ring for receiving at least a portion of the lockdown member while the lockdown member is in the unengaged position, the cam surface defining an upper end of the annular recess, and the upward facing shoulder defining a lower end of the annular recess; and wherein the recess has an axial length substantially the same as an axial length of said at least a portion of the lockdown member.

3. The seal assembly of claim 1, further comprising:

a cylindrical surface on the inner circumference of the energizing ring extending upward from the cam surface, the cylindrical surface having a length such that the energizing ring can move downward further into the slot after the cam surface has moved the lockdown member into the engaged configuration.

4. The seal assembly of claim 1, wherein the lockdown member has a lower portion that is thicker than an upper portion, defining a transition on an outer circumference of the lockdown member, the transition being located below the cam surface and the upper portion extending above the cam surface while the lockdown member is in the unengaged position, and the seal assembly further comprises:

an annular recess on the inner circumference of the energizing ring for receiving the lower portion of the lockdown member while the lockdown member is in the unengaged position, the cam surface defining an upper end of the annular recess, and the upward facing shoulder defining a lower end of the annular recess; and a cylindrical surface on the inner circumference of the energizing ring extending upward from the cam surface, the cylindrical surface having a length such that the energizing ring can move downward further into the slot after the cam surface has moved the lockdown ember into the engaged configuration.

5. The seal assembly of claim 1, wherein the lockdown member is a split ring.

6. The seal assembly of claim 1, further comprising a hanger lockdown assembly connected between the wellhead members below the seal element, and comprising an outer coupling that is forced outward into engagement with a recess provided in the outer wellhead member in response to downward movement of the seal element caused by downward movement of the energizing ring.

7. A wellhead assembly comprising:

an outer wellhead member adapted to be anchored at an upper end of a borehole;

an inner wellhead member landed within the outer wellhead member, and defining an annulus provided between the inner and outer wellhead members;

a grooved profile on an exterior surface of the inner wellhead member;

a metal seal assembly in the annulus, having an outer leg and an inner leg, defining an annular channel between the inner leg and the outer leg;

an energizing ring insertable into the channel between the inner leg and the outer leg to force the inner leg and the outer leg apart from each other and into sealing engagement with the inner wellhead member and the outer wellhead member, respectively;

a cam surface on an inner diameter of the energizing ring;

a cylindrical surface extending upward from the cam surface on the inner diameter of the ring;

a radially contractable lockdown member having a base portion that comprises a solid ring supported on an upper end of the inner leg of the seal assembly, the lockdown member having an upper portion comprising collet fingers cantilevered to the base portion, the collet fingers having inner surfaces comprising a grooved portion;

the upper portion being engaged by the cam surface as the energizing ring moves downward, wherein moving the energizing ring into the channel causes the fingers to be engaged by the cam surface and pushes the grooved profile of the fingers into engagement with the grooved profile on the inner wellhead member;

wherein the cam surface is positioned to slide below upper ends of the fingers, and the cylindrical surface is positioned on the inner diameter of the ring to slidingly engage the fingers after the fingers are in engagement with the grooved profile of the inner wellhead member; and wherein the cylindrical surface on the inner diameter of the ring has a length selected such that after the collet fingers engage the grooved profile on the inner wellhead member, the energizing ring may continue downward movement in the channel to move the inner and outer legs into sealing engagement with the inner wellhead member and the outer wellhead member, respectively.

8. The wellhead assembly of claim 7, further comprising a hanger lockdown assembly connected between the wellhead members below the seal element, and comprising an outer coupling that is forced outward into engagement with a recess provided in the outer wellhead member in response to downward movement of the seal element caused by downward movement of the energizing ring.

9. A wellhead assembly comprising:

an annular outer wellhead member adapted to be anchored in a borehole;

an inner wellhead member landed within the outer wellhead member, the inner wellhead member having an outer circumference, and defining an annulus provided between the inner and outer wellhead members;

wickers formed on the outer circumference of the inner wellhead member;

a seal assembly in the annulus, having an annular channel provided in the seal assembly;

an energizing ring insertable into the channel to provide a force for urging inner and outer surfaces of the seal assembly into respective engagement with the inner and outer wellhead members;

an annular recess on an inner side wall of the energizing ring, the recess having a lower end defined by an upward facing shoulder;

a radially contractable lockdown member having at least a portion located in the recess and a lower end in contact with an upper send of the seal member while in a disengaged position, wherein downward movement of the energizing ring as it is inserted into the channel, pushes the lockdown member from the recess into an engaged position in engagement with the wickers on the inner wellhead member; and wherein moving the energizing ring upward from the channel causes the upward facing shoulder to engage the lower end of the lockdown member so the seal assembly can be removed from the annulus.

* * * * *